United States Patent [19]

Tillman

[11] Patent Number: 5,042,812

[45] Date of Patent: Aug. 27, 1991

[54] GOLF COURSE TOOL STORAGE SYSTEM

[76] Inventor: Stan Tillman, 605 Mai St., Evansville, Ind. 47708

[21] Appl. No.: 617,781

[22] Filed: Nov. 26, 1990

[51] Int. Cl.[5] ..... A63B 67/02; A63B 57/00; B65D 85/54; A01O 7/00

[52] U.S. Cl. ..... 273/176 B; 273/32 B; 172/713; 220/484; 206/315.1; 56/400.0

[58] Field of Search ..... 273/32 R, 32 B, 176 R, 273/176 B; 172/713; 206/349; 220/484; 56/400.01, 400.04

[56] References Cited

U.S. PATENT DOCUMENTS

| | | | |
|---|---|---|---|
| 1,538,309 | 5/1925 | Thackeray et al. | 15/265 |
| 2,110,538 | 3/1938 | Walsh | 55/10 |
| 2,564,472 | 8/1951 | Farnham | 206/15.1 |
| 2,821,834 | 2/1958 | Walker | 56/400.19 |
| 3,124,399 | 3/1964 | Seta | 312/206 |
| 3,210,111 | 10/1965 | Fallon | 294/19 |
| 3,390,516 | 7/1968 | Burrows | 56/400.19 |
| 3,466,048 | 9/1969 | Anderson et al. | 273/176 R |
| 3,584,739 | 6/1971 | Erichson | 206/16 |
| 4,535,989 | 8/1985 | Lovin | 273/176 B X |
| 4,934,550 | 6/1990 | Cash | 220/18 |

*Primary Examiner*—George J. Marlo
*Attorney, Agent, or Firm*—Woodard, Emhardt, Naughton, Moriarty & McNett

[57] ABSTRACT

A rake storage system is disclosed for use in close proximity to golf course sand traps. This system includes a storage tube which is insertable in the ground and a golf course rake whose handle slides into the tube so that only the rake head is exposed. Also included in this system is a sleeve which slides into the tube to provide an indexing mechanism which automatically rotates the rake to a desired orientation as the rake is inserted in the tube. Indexing is accomplished by a tab incorporated onto the rake handle engaging a slot incorporated within the sleeve. In another embodiment, the rake handle has a uniquely shaped upper portion which engages in a sleeve with a like shaped upper portion so that the rake is at the desired orientation when the rake is installed in the tube. In yet another embodiment, the rake head is of a specific shape and weight so that the rake head center of mass is at a distance from an axis defined by the rake handle, thereby creating a gravity effect on the rake which rotates the rake downward as the rake is inserted in the tube.

20 Claims, 9 Drawing Sheets

GOLF COURSE TOOL STORAGE SYSTEM

BACKGROUND OF THE INVENTION

The present invention relates generally to a tool storage system for use in golf courses, and more specifically, to rake storage systems for use in close proximity to a golf course sand trap.

To the chagrin of golfers everywhere, many an errant golf shot has ended with the golf ball rolling into a sand trap. The player having hit the ball then follows into the sand trap to strike at the ball with his next swing. Typically the action of the player walking on the sand in addition to the divot he takes when he swings at the ball leaves the sand within the sand trap disturbed, and if left unattended, affecting the roll of the next ball hit into the sand trap. Out of courtesy to other players, after a player has cleared his ball from the sand trap, he is expected to leave the sand trap in the same undisturbed condition as when he found it. To help him smooth over the sand trap, many golf courses leave rakes either in the sand trap or along side it. The disadvantage of leaving the rake in the sand trap or along side it is the potential that a golf ball will strike the rake, thereby affecting the trajectory of the ball and distorting the shot.

Various devices have been conceived in order to provide the player with ready access to the rake while still locating the rake beyond a golf ball's path. One device conceals the rake in a container in the golf course thereby preventing the ball from striking the rake while the rake is not in use. This device by Edward C. Erichson, U.S. Pat. No. 3,584,739, utilizes a container buried in the ground adjacent to a sand trap for storage of the sand trap rake. The container has a hinged cover having an artificial turf surface mounted flush with the ground. When the rake is not in use, the container is covered, and the rake is entirely hidden from sight. The cover itself forms a playing surface across which the ball can roll.

Another device by Cash, U.S. Pat. No. 4,934,550 discloses a rake storage system somewhat similar to Erichson in that the rake is concealed in a container buried in a golf course, the difference being that Erichson covers the the rake and the container, while Cash does not.

Other inventions have been devised which make the rake a collapsible rake and therefore easily carried by the golfer as he walks the golf course. Examples of this type of sand trap rake include W. J. Walsh, U.S. Pat. No. 2,110,538 and E. F. Walker, U.S. Pat. No. 2,821,834. Still another collapsible rake is by D. L. Burrows, U.S. Pat. No. 3,390,516 and a detachable rake head which attaches to a golf club head by W. N. Fallon, U.S. Pat. No. 3,210,111.

By using a collapsible rake, the rake is carried with the player, thereby leaving no rake near the sand trap. The disadvantage of this is that when a player comes by without a rake he has no means by which to smooth over the sand trap. A rake inserted within a container and covered by an artificial turf lid near a sand trap distorts the feature of the golf course by having an artificial turf section. In addition the rake cannot be seen thereby potentially requiring some sort of sign or other marking.

The present invention disposes only the rake handle into the ground and allows only the rake head to be visible and on display. The golfer can readily spot the location of the rake, retrieve it to smooth over the sand trap after his shot, and when finished slide the rake handle into a storage tube buried in the ground leaving the rake head fully exposed. Furthermore, the location of the storage tube beneath a sand trap fringe also minimizes the chance of a ball hitting the rake head itself.

A rake laying around the sand trap not only provides an obstacle for the ball itself, but may be dangerous to the inattentive player stepping on it. The present invention eliminates this problem while still keeping the rake on display and accessible to all golfers on the golf course. The rake storage system design is also not prone to breakage or malfunction, and does not present an added cost of an extra tool that each individual golfer must bear.

Finally, the rake storage system is adaptable to any type of golf course tool around any hazard. For example, if a player encounters a water hazard, he either has to retrieve his ball by himself with his hands, or carry with him a long handled ball scoop in his golf bag. With the present storage system, the tube can be inserted in the ground near the water hazard, with the golf ball scoop insertable into the tube. The scoop is displayed so that the player can look to it, retrieve his ball, and then reinsert the tool within the storage tube. With such tools, the advantage of the present tool storage system is that only the head of the tool is displayed to attract a player's attention, and by careful location of the storage tube, the tool presents a minimal obstruction to golf ball trajectories.

SUMMARY OF THE INVENTION

According to one embodiment the present invention provides a rake having an elongated handle with a bottom end and a top end, a rake head with rake tines at the top end of the handle, an elongated storage tube disposable into an earthen wall forming a perimeter of a sand trap, the tube being disposed at an angle ranging from approximately 0 to 30 degrees relative to the earthen wall, the tube having a bottom end and a top end, the top end of the tube having an opening which is substantially flush with the earthen wall, the top end of the tube having an insertable lid, the bottom end of the tube being tapered toward the center of the tube, the bottom end of the tube having a drainage opening, a sleeve insertable in the tube, the sleeve being removable and having an upper end with an opening for receiving the bottom end of the rake handle, the sleeve being sufficiently small to prevent passage of the rake head therethrough, the sleeve having indexing means comprising a longitudinal indexing slot and an angled receiving end, the rake handle having indexing means comprising a tab protruding from the rake handle, wherein the tab engages the angled end of the sleeve in a cam action to rotate the rake handle until the tab engages the slot, thereby orienting the rake head with its rake tines pointed downward when the rake is inserted in the tube.

According to another embodiment the indexing means comprises a tube disposable into the earthen wall at a non-vertical angle, a handle defining a handle axis, a rake head which is weighted so that the rake head has a center of mass that is at a distance from the handle axis, thereby orienting the rake head with its rake tines pointed downward when the rake is stored in the tube.

According to another embodiment, the indexing means comprises the tube upper opening having a noncircular shape and the rake having a noncircular shape incorporated into the top end of the rake handle, so that the noncircular shape of the handle nests into the noncircular shape of the upper opening to orient the rake head with its rake tines pointed downward when the rake is stored in the tube.

A general object of the present invention is to provide a rake storage system for use near a golf course sand trap which displays the rake to a golfer and is convenient for the golfer to use, while at the same time minimizing the rake as an obstacle to a golf ball's path.

Another related object of the present invention is to provide a rake storage system which displays a rake while at the same time minimizing the rake as an obstacle to a golf ball's path, and which can be easily incorporated by a golf course thereby relieving the golfer of the burden of carrying a rake and providing a rake to any and all golfers playing through a particular sand trap.

Another related object of the present invention is to provide a rake storage system which does not alter any of the usable golf course playing surface while at the same time minimizing the rake as an obstacle to a golf ball's path, thereby maintaining a pristine playing surface while still conveniently presenting the rake to any and all golfers.

Another related object of the present invention is to provide an indexing feature which orients the rake head for the golfer as he inserts the rake into the tube so that the chance for erroneous insertion are reduced thereby further minimizing the chance for a golf ball to hit the rake once the rake is installed.

Other related objects and advantages of the present invention are disclosed in the following description of the preferred embodiments.

DESCRIPTION OF THE PREFERRED EMBODIMENT

Figure 1:
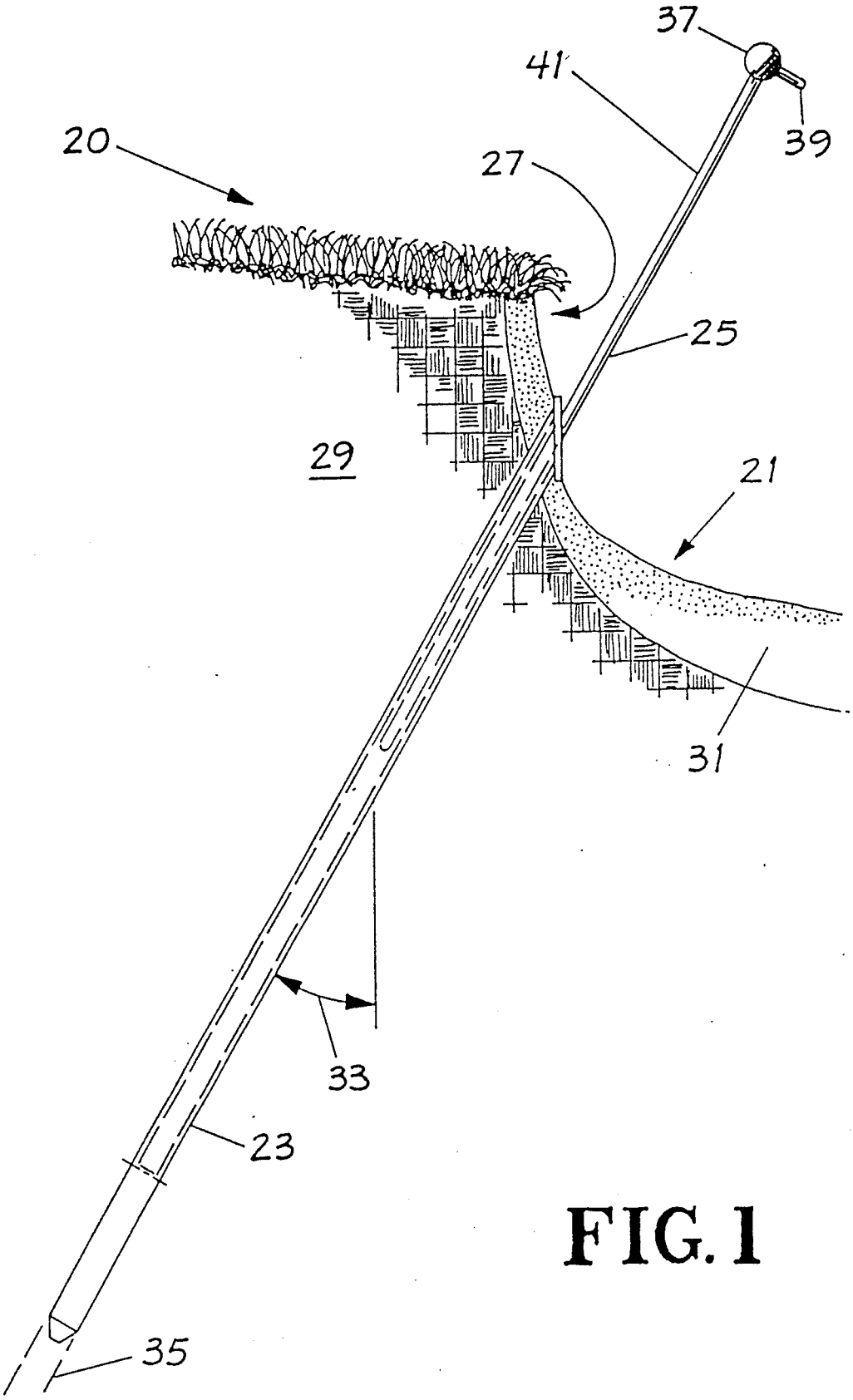
FIG. 1 is a side elevation partial cross-sectional view of a first embodiment of the present invention depicting the rake partially installed.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device and method, and such further applications of the principles of the invention as illustrated therein being contemplated as would normally occur to one skilled in the art to which the invention relates.

Referring now to FIG. 1, a typical installation is shown of a rake storage system 20 located within a sand trap 21. Rake storage system 20 is comprised of a storage tube 23 and a rake 41. In this illustration, rake 41 is shown partially inserted within storage tube 23. Rake 41 is comprised of a handle 25 and a rake head 37 which also incorporates a raking feature. Although many raking features will perform the desired raking function, rake head 37 incorporates tines (or teeth) 39 as its raking feature. Although rake storage system 20 can be used anywhere within close proximity to sand trap 21, the best location is where storage tube 23 is located underneath a sand trap lip 27 and above the sand 31 within sand trap 21. A hole 35 is first drilled or otherwise dug into the earthen wall 29 surrounding the sand trap 21, and storage tube 23 is then inserted into drilled hole 35. Drilled hole 35 should be of sufficient diameter to provide a close fit with tube 23, thereby locking tube 23 in place once it is inserted into the ground. Tube 23 can be inserted into earthen wall 29 at any angle between horizontal and vertical; however, in the illustrated embodiment, an angle 33 of 0 to 30 degrees relative to vertical provides the best performance.

Figure 2:
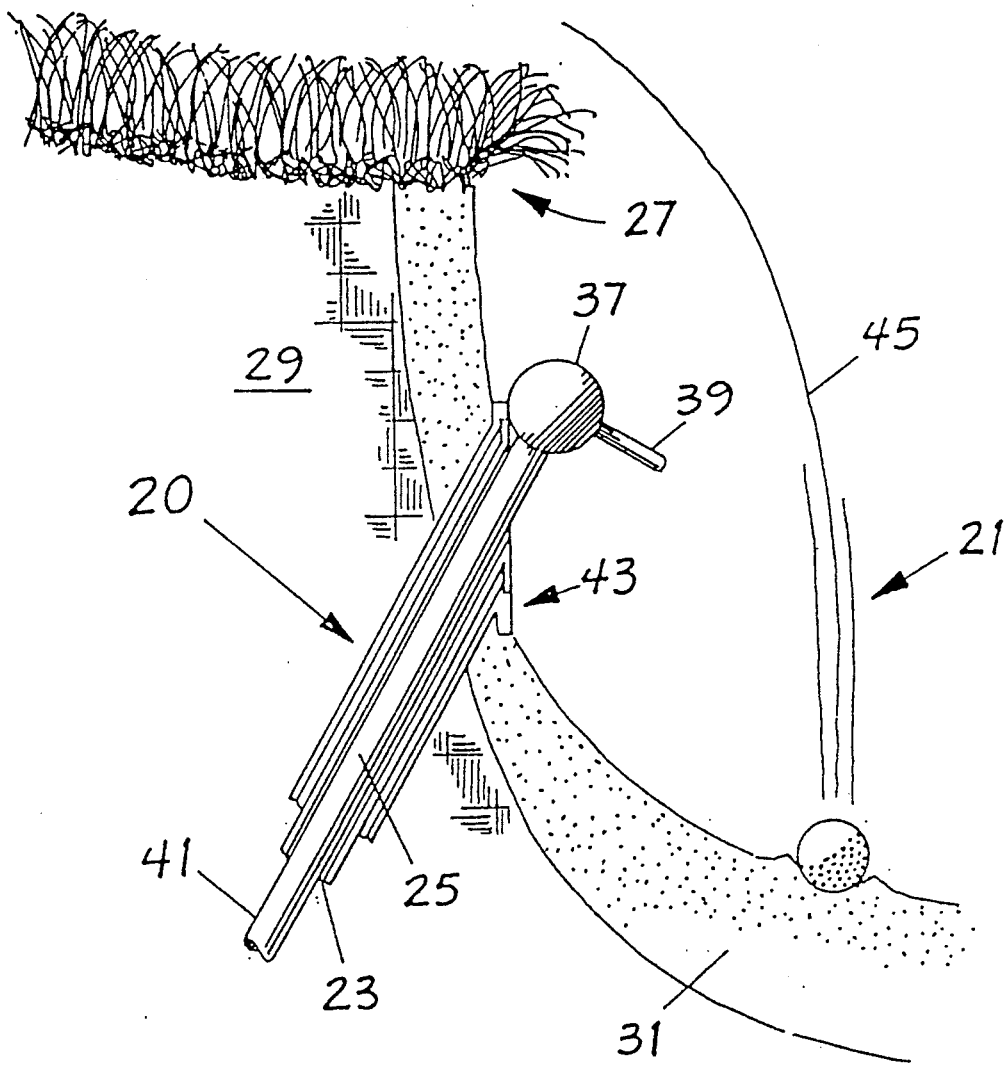
FIG. 2 is a side elevation partial cross-sectional view of the device of FIG. 1 depicting the rake fully installed.

Referring now to FIG. 2 rake 41 is shown fully inserted into tube 23. The exposed end 43 of tube 23 is shown flush with the earthen wall 29. Although exposed end 43 can be upstanding from the earthen wall 29, the preferred flush installation allows rake head 37 to be nearer to the earthen wall 29 and therefore less exposed. As illustrated in FIG. 2, a golf ball's momentum will result in a trajectory 45 over rake head 37 before embedding in the sand 31. For this reason rake storage system 20 should be located in wall 29 of sand trap 21 so that the majority of golf ball trajectories will pass over rake head 37 similar to trajectory 45. Ideally, this location should be in wall 29 toward the tee and away from the green so that the rake is not in the way of the golf ball approaching the green. FIG. 2 also shows rake head 37 in its preferred orientation; that is, with tines 39 of rake 41 pointed downward toward the bottom of sand trap 21, thereby also minimizing rake head 37 exposure to golf ball trajectory 45.

Because it is preferable to have tines 39 pointing downward, a mechanism for indexing rake 41 with respect to tube 23 is provided. A positive indexing mechanism automatically orients rake head tines 39 downward as rake 41 is inserted into tube 23, regardless of the initial orientation of rake 41 at the beginning of its insertion.

Figure 3:
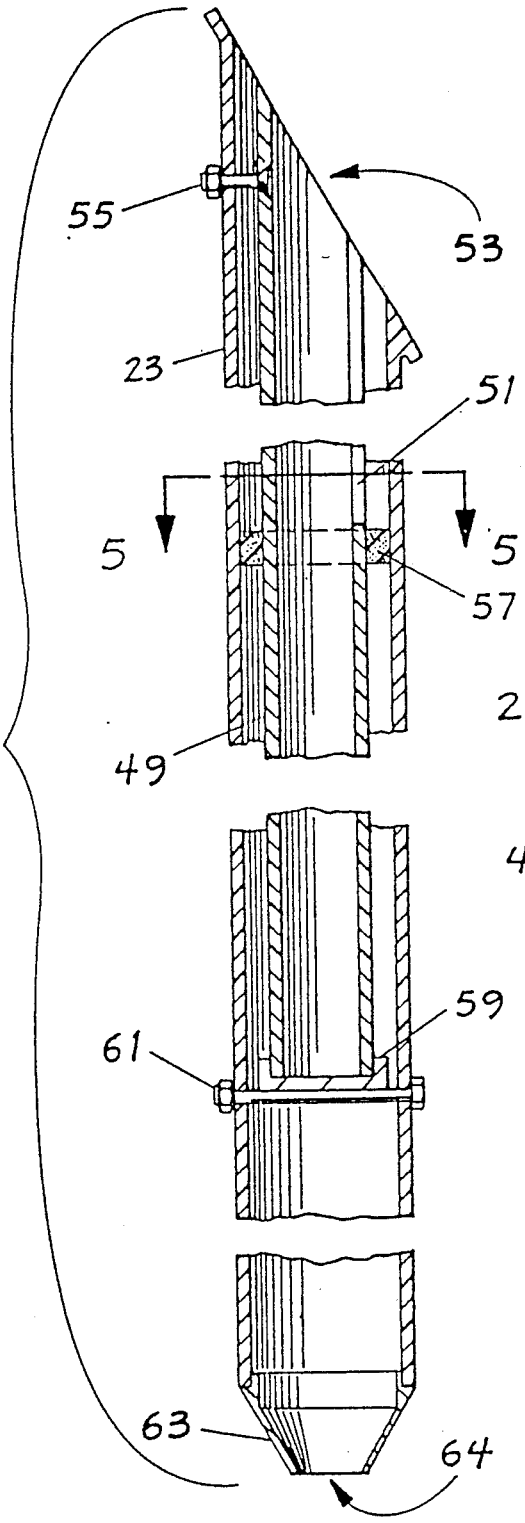
FIG. 3 is a fragmented side cross-sectional view of the first embodiment showing the storage tube, sleeve, and indexing slot of the present invention.
Figure 4:
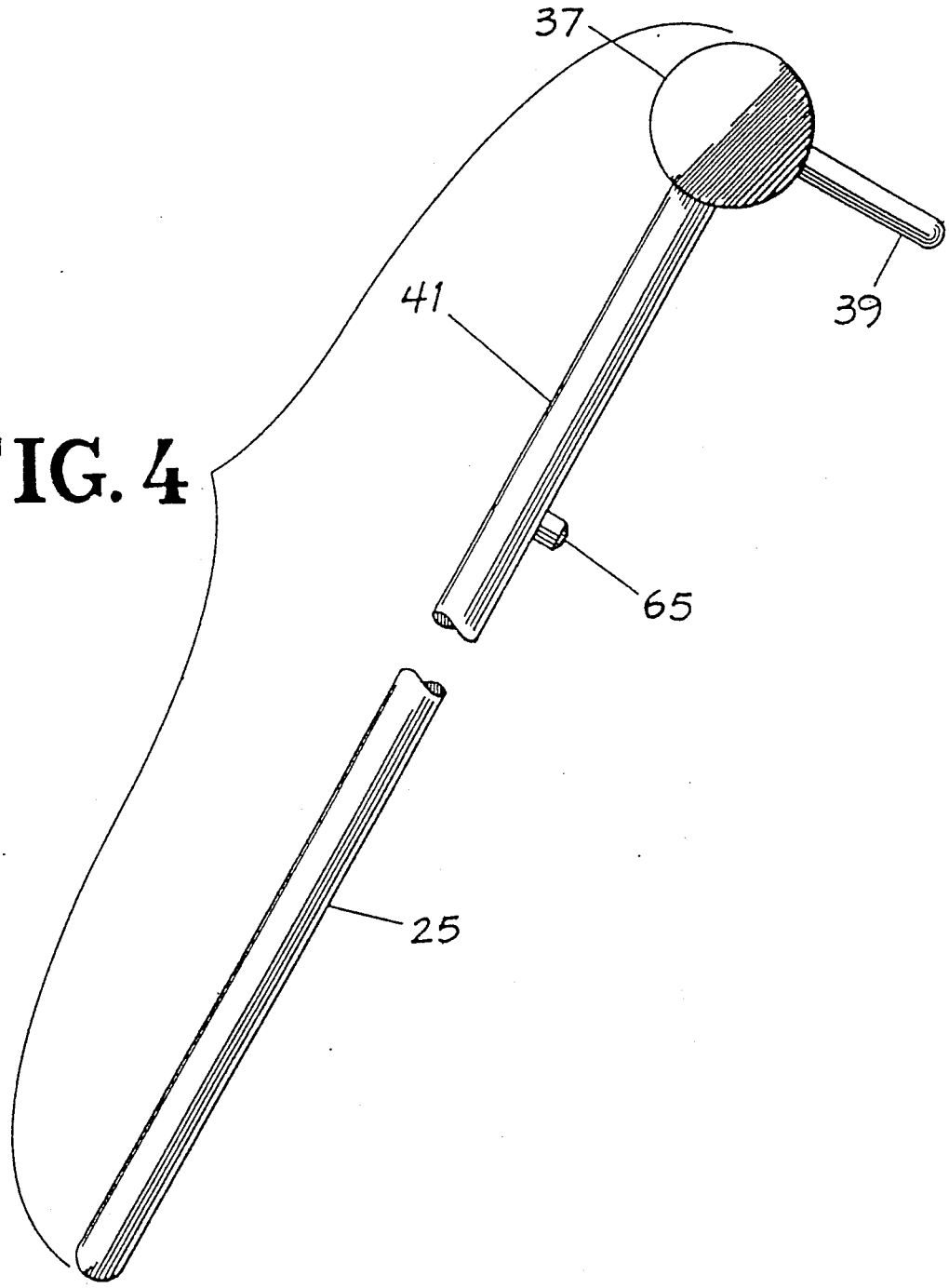
FIG. 4 is a side elevation view showing the rake of the first embodiment of the present invention.

FIG. 3 and FIG. 4 depict the individual tube and rake assemblies and also depict the preferred indexing mechanism. In FIG. 3 a sleeve 49 is insertable within tube 23. Sleeve 49 is removable thus allowing for cleaning of leaves, dirt and other debris, and for repair. Sleeve 49 incorporates a ramped camming surface 53 (FIG. 3) and a vertical slot 51 for indexing of rake 41 with respect to the tube and sleeve and about the rake handle's longitudinal axis. Sleeve 49 also has encircling a portion of its outer diameter a collar 57. This collar is located at the bottom of indexing slot 51 and provides support for sleeve 49 when inserted within tube 23. Sleeve 49 and tube 23 have correlating holes through which a fastener 55 is inserted which attaches sleeve 49 to tube 23, thereby orienting the indexing slot 51 to the earthen wall 29 via tube 23. A fastener 61 is bolted through tube 23 to provide a stop for sleeve 49, so that the weight of the sleeve and rake when installed is supported between fastener 55 and fastener 61. Sleeve 49 also incorporates at its bottom end a cap 59 which is permanently attached. Tube 23 also employs a permanently attached cap 63 at its bottom. Cap 63 is tapered to assist in the insertion of tube 23 into hole 35 in earthen wall 29. Cap 63 further provides for drainage by having an opening 64 therein.

Figure 5:
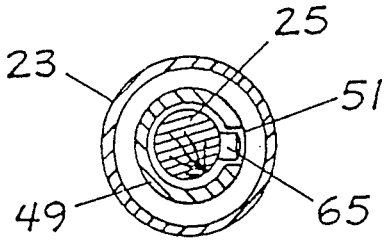
FIG. 5 is a cross-sectional view taken along line 5—5 in FIG. 3 showing the indexing feature of the rake handle inside the sleeve of the present invention.

Referring now to FIG. 3, FIG. 4 and FIG. 5, rake 41 has a typical cylindrical rake handle 25, although other shapes such as an oval or a triangular shape are envisioned as well. To provide for indexing, a tab 65 is incorporated and protrudes outward, preferably near the top end of the rake handle 25. Tab 65 is oriented on rake handle 25 relative to rake bead 37 so that tab 65 engages within indexing tube slot 51 to position rake head 37 with tines 39 pointing downward. The automatic indexing mechanism is provided by the cam action of tab 65 as it contacts the angled surface 53 of sleeve 49. Upon contact with angled surface 53, tab 65 will rotate while sliding down surface 53, engaging slot 51 at the end of rake 41 rotation as shown in FIG. 5.

Tube 23 and sleeve 49 can be of many different configurations and materials while still performing in the manner described above. The optimum configuration is a balance of function, cost, and complexity. In the preferred embodiment among other considerations the material chosen is a balance of cost versus the ability to resist weathering and corrosive effects. Because tube 23 and sleeve 49 will encounter the most moisture due to their location in the ground, a plastic material is utilized for the illustrated embodiment, and to reduce cost standard PVC tubing is utilized. The rake handle 25 can be any typical rake handle material such as wood or plastic. If plastic is used, the tab 65 and rake head 37 can be molded directly into the handle itself. Keeping in mind initial cost as well as repair and replacement cost however, the preferred embodiment employs a standard wooden rake handle with tab 65 and rake head 37 fastened to wooden handle 25. Tab 65 is made from nylon, although any low friction durable material may be used, and tab 65 is screwed into handle 25. As an alternative approach, tab 65 can be a sleeve of a durable material which is trapped by a headed fastener to the handle, so that the sleeve is able to rotate about the fastener resulting in a rolling rather than a sliding motion. Although not the preferred embodiment, a hollow handle can be chosen as well, and in that case a wooden dowel could be inserted into handle 29 to provide a threadable base for tab 65 to be attached.

Although rake 41 and tube 23 can be of many sizes, in the preferred embodiment, rake handle 25 has a 1 inch diameter, and tube 23 is made from 2 inch diameter PVC plastic tubing (keeping in mind that PVC tubing is sold by inner diameter size, thus a 2 inch diameter PVC tube has an inner diameter of 2 inches and an outer diameter of approximately $2\frac{3}{8}$ inches). Sleeve 49 is made from 1 inch diameter PVC plastic tubing.

Referring now to FIG. 3, in the preferred embodiment the tube 23 inserted in the ground is approximately 6 feet long. The sleeve 49, which is removable for cleaning, is a lessor length than the tube length itself and is approximately 5 feet, leaving 1 foot of clearance between the bottoms of sleeve 49 and tube 23. Angled surface 53 is cut at a 30 degree angle relative to vertical and slot 51 is approximately $\frac{3}{8}$ inch wide so that a $\frac{3}{8}$ inch tab can slide into it. The length of angled surface 53 and slot 51 combine so that the bottom of the slot is 1 foot from the uppermost portion of sleeve 49. Fastener 61 bolts through tube 23 approximately 11 5/16 inches from the bottom of tube 23 and can be any standard bolt and nut combination. In the preferred illustration, however, a $10\text{-}24\times2\frac{1}{2}$ long bolt and nut combination is used. Fastener 55 is similar to fastener 61, however it is only 1 inch long giving a $10\text{-}24\times1$ flat head machine screw and nut combination.

Referring now to FIG. 4, rake 41 has handle 25 with a length of $4\frac{1}{2}$ feet. Tab 65 is fastened to handle 25 approximately 10 inches from rake head 37. The location of tab 65 on handle 25 is somewhat critical in that if tab 65 is located too near rake head 37, the automatic indexing mechanism of tab 65 into angled surface 53 will attempt to rotate rake 41 when rake 41 is almost fully inserted into tube 23. Because rake head 37 has a width associated with it, the rake head 37 will not be able to rotate due to interference with either the sodded fringe 27 or the sand 31. The location of tab 65 is therefore chosen to prevent this potential interference while still maintaining the desirous feature of having rotation occurring when rake 41 is mostly installed into tube 23, thereby providing a more stable system. The rake head 37 can be of a common design; however, in this embodiment, the rake head 37 is 2 inches wide with the tines 39 being 1 inch long. The rake head length itself is determined by the size of the sand trap. If it is a large sand trap, the rake head length would be sufficient so as to require relatively few raking actions to smooth over the sand trap. If the sand trap is small, however, the rake head would also have to be sufficiently short so as not to protrude from the earthen wall into a golf ball trajectory.

Figure 6:
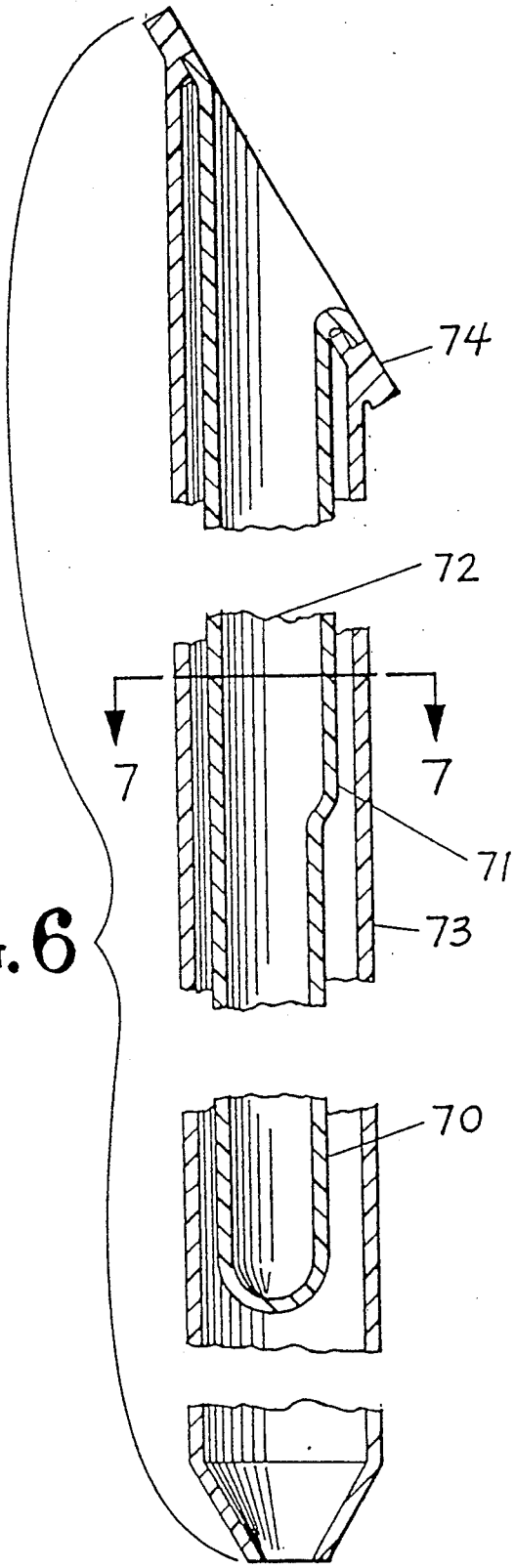
FIG. 6 is a side cross-sectional view showing the storage tube, sleeve, and indexing feature for a second embodiment of the present invention.
Figure 7:
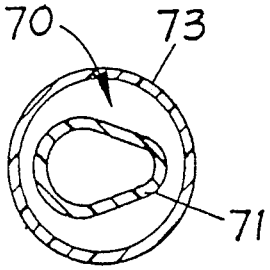
FIG. 7 is a cross-sectional view taken along line 7—7 of FIG. 6 showing an alternate indexing feature on the second embodiment of the present invention.
Figure 8:
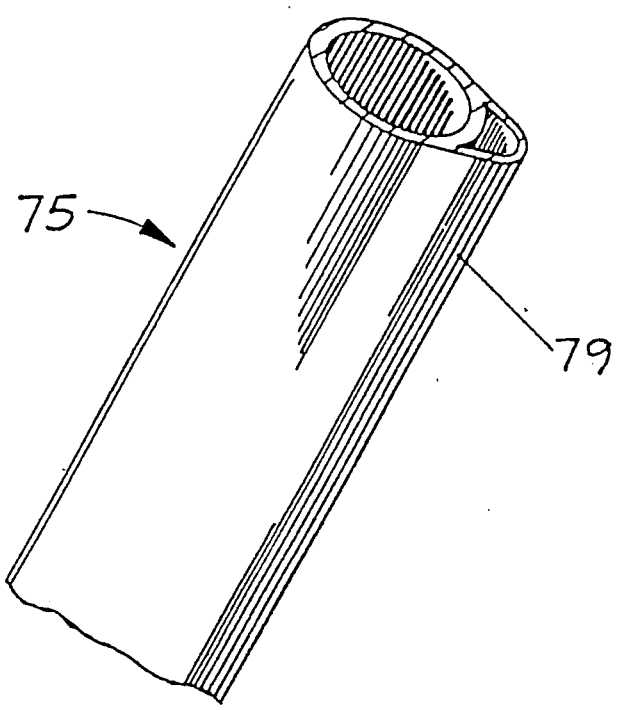
FIG. 8 is a partial perspective view showing the indexing feature on the rake of the second embodiment of the present invention.
Figure 9:
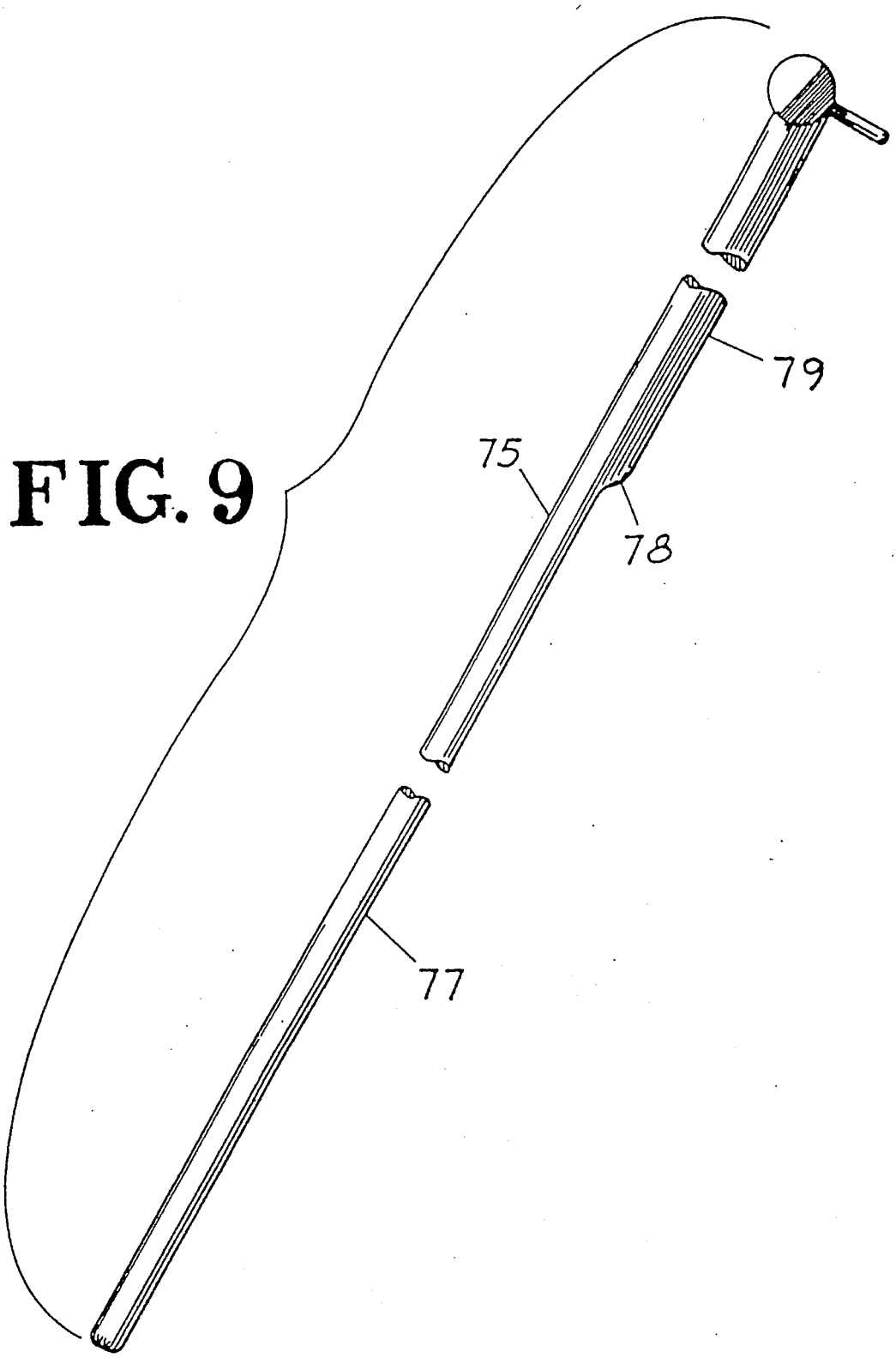
FIG. 9 is a side elevation view showing the rake of the second embodiment of the present invention.

Other mechanisms are provided by this invention. Referring now to FIG. 6 and FIG. 7, an alternate embodiment is depicted having a sleeve 70 which is installed and supported at the exposed edge 74 of tube 73 and which has a uniquely oriented non-circular shape 71 to the upper portion 72 of its length. Referring now to FIGS. 8 and 9, the rake handle 75 incorporates in a portion of its length a corresponding non-circular shape 79. The remaining portion 77 of handle 75 is circular, although other shapes would be equally functional. The noncircular shape 79 is incorporated along the top 1 foot portion of rake handle 75. Where the rake handle 75 transfers from a circular rake handle 77 to the noncircular shape 79 will be the point 78 at which the engagement begins as rake handle 75 is installed into sleeve 72.

The non-circular shape 79 can be most any shape; however, it is preferred that the shape is chosen so that the rake can only be installed in a downward position. Another shape for instance may be that of non-equilateral triangle.

Figure 10:
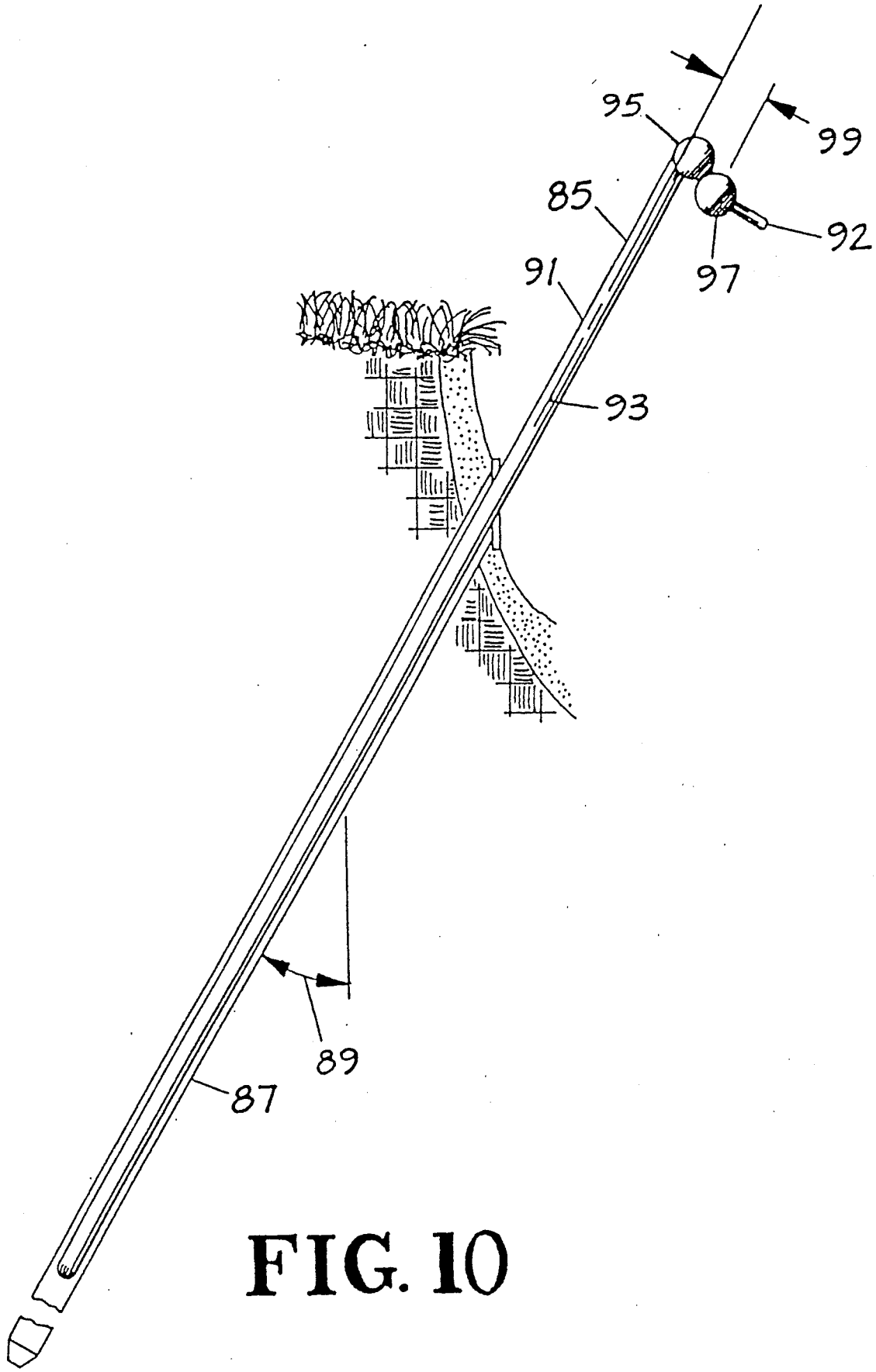
FIG. 10 is a side elevation partial cross-sectional view of a third embodiment of the present invention.

Still another alternate embodiment is shown in FIG. 10 having indexing means which consist of a specially weighted sand trap rake 85 in combination with a tube 87 inserted at a non-vertical angle 89. Rake handle 91 defines a central axis 93, and rake head 95 has a center of mass 97 which is at an eccentric distance 99 from central axis 93. The gravity effect on rake 85 results in rake head 95 being at rest only with tines 92 pointed downward, thereby automatically orienting rake head 95 downward as rake 85 is inserted into tube 87.

Figure 11:
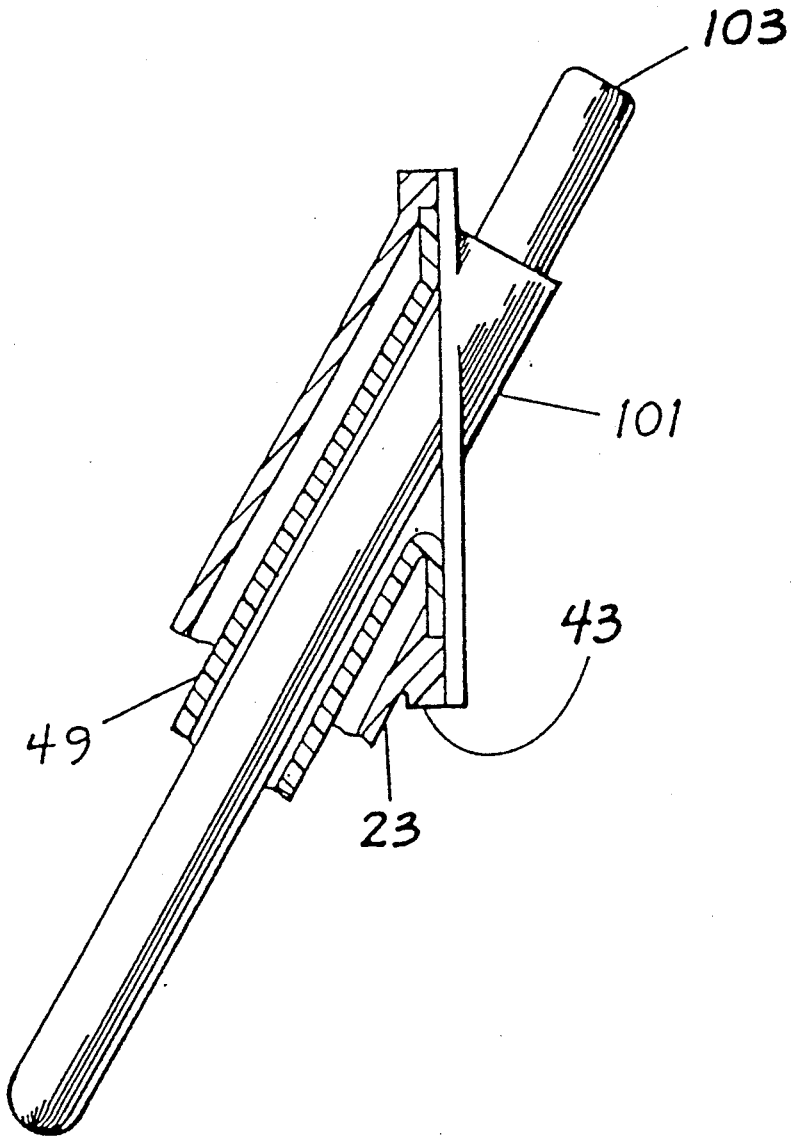
FIG. 11 is a side elevation partial cross-sectional view showing an optional lid and its placement into the tube of the present invention.

Another feature which can be included in any of the above embodiments and is included in the preferred embodiment is a lid 101 shown in FIG. 11 which covers the tube when the rake is not installed, such as during the off-season. The lid may be fastened via a chain, hinged to exposed end 43, or threaded into exposed end 43. In the preferred embodiment, lid 101 is a molded plastic piece which inserts into exposed end 43 when rake 41 is not installed. Lid 101 has a handle 103 which provides a grasping surface so that lid 101 can be easily removed. Although it is envisioned that the hinged means of attachment, for example, would provide a lid that is always present whether the rake is installed or not, the preferred embodiment employs lid 101 when rake 41 is not installed for longer periods of time than just when in use by a golfer. Lid 101 provides protection of tube 23 and sleeve 49 from any moisture, dirt or anything else which could fall into tube 23 when rake 41 is not installed.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A tool storage system for use in close proximity to a golf course hazard; such as a sand trap, water hazard or the like, comprising:

a tool having an elongated handle with a bottom end and a top end, and further having a tool head at said top end of said handle;

a storage tube disposable underground, wherein said tube has a bottom end and a top end, said top end having an exposed upper opening for receiving said bottom end of said handle therethrough, and wherein said tube is elongated to receive said handle for storage therein; and, indexing means including camming means for orienting said tool about an elongated central axis defined by said storage tube, said orientation being a predefined angular relationship with said storage tube.

2. The system of claim 1 wherein said tool storage system comprises a rake storage system in close proximity to a sand trap, wherein said tool comprises a rake, and wherein said tool head comprises a rake head.

3. The system of claim 2 further comprising a sleeve insertable inside said tube, wherein said sleeve has an upper end with an opening for receiving said bottom end of said rake handle therethrough, said sleeve is sufficiently small to prevent passage of said tool head therethrough, and said sleeve is removable from said tube.

4. The system of claim 3 wherein said indexing means includes means for rotating said rake handle as said rake handle is inserted into said tube.

5. The system of claim 4 wherein said sleeve has a longitudinal indexing slot and an angled receiving end forming a camming ramp, and a tab protruding from said rake handle, so that said tab engages said angled end of said sleeve in a cam action to rotate said rake handle until said tab engages said slot, thereby orienting said rake head with rake tines pointed downward when said rake is stored in said tube.

6. The system of claim 5 wherein said tube is disposed into an earthen wall, said earthen wall forming an upright perimeter wall of said sand trap and shielding said rake head from a golf ball trajectory.

7. The system of claim 6 wherein the bottom end of said tube has a drainage opening.

8. The system of claim 7 wherein the bottom end of said tube is tapered toward said central axis.

9. The system of claim 8 wherein said central axis of said tube is tilted at an angle ranging from approximately 0 to 30 degrees relative to vertical, and wherein said rake head is oriented with rake tines pointed downward when said rake is stored in said tube at said predefined angular relationship.

10. The system of claim 9 wherein said top end opening is substantially flush with said earthen wall.

11. The system of claim 2 wherein the bottom end of said tube is tapered toward an elongated central axis defined by said storage tube.

12. The system of claim 2 wherein said storage tube defines an elongated central axis, said central axis of said tube is tilted at an angle ranging from approximately 0 to 30 degrees relative to vertical, and wherein said rake head is oriented with rake tines pointed downward when said rake is stored in said tube at said predefined angular relationship.

13. The system of claim 2 wherein said top end opening is substantially flush with said earthen wall.

14. The system of claim 2 wherein said tube is disposable into said earthen wall at a non-vertical angle, and wherein said handle defines a handle axis, and said rake head is weighted so that said rake head has a center of mass that is at a distance from said handle axis, thereby orienting said rake head with rake tines pointed downward when said rake is stored in said tube.

15. The system of claim 2 wherein said indexing means further comprises said upper opening having a noncircular shape and said rake having a noncircular shape incorporated into the top end of said rake handle so that said noncircular shape of said handle nests into said noncircular shape of said upper opening to orient said rake head with rake tines pointed downward when said rake is stored in said tube.

16. The system of claim 2 wherein said indexing means further comprises a sleeve disposed within said storage tube, said sleeve having a longitudinal indexing slot and an angled receiving end forming said camming ramp, and a tab protruding from said rake handle, so that said tab engages said angled end of said slotted tube in a cam action to rotate said rake handle until said tab engages said slot, thereby orienting said rake head with rake tines pointed downward when said rake is stored in said tube.

17. A tool storage system for use in close proximity to a golf course hazard; such as a sand trap, water hazard or the like, comprising:

a tool having an elongated handle with a bottom end and a top end, and further having a tool head at said top end of said handle;

a storage tube disposable underground, wherein said tube has a bottom end and a top end, said top end having an exposed upper opening for receiving said bottom end of said handle therethrough, and wherein said tube is elongated to receive said handle for storage therein; and a sleeve insertable inside said tube, wherein said sleeve has an upper end with an opening for receiving said bottom end of said rake handle therethrough, said sleeve is sufficiently small to prevent passage of said tool head therethrough, and said sleeve is removable from said tube.

18. The system of claim 17 wherein said tube is disposable into an earthen wall, said earthen wall forming an upright perimeter wall of said sand trap and shielding a rake head from a golf ball trajectory.

19. The system of claim 17 wherein the bottom end of said tube has a drainage opening.

20. The system of claim 17 and further including support means disposed between said tube and said sleeve for supporting said sleeve.

* * * * *

UNITED STATES PATENT AND TRADEMARK OFFICE

CERTIFICATE OF CORRECTION

PATENT NO. : 5,042,812

DATED : August 27, 1991

INVENTOR(S) : Stan Tillman

It is certified that error appears in the above-identified patent and that said Letters Patent is hereby corrected as shown below:

In Column 5, at Line 27, "bead" should read --head--

Signed and Sealed this

Twelfth Day of January, 1993

*Attest:*

*Attesting Officer*

DOUGLAS B. COMER

*Acting Commissioner of Patents and Trademarks*